US010991296B2

(12) United States Patent
Huang

(10) Patent No.: US 10,991,296 B2
(45) Date of Patent: Apr. 27, 2021

(54) DISPLAY PANEL DRIVING CIRCUIT, AND DISPLAY DEVICE

(71) Applicants: HKC Corporation Limited, Guangdong (CN); Chongqing HKC Optoelectronics Technology Co., Ltd., Chongqing (CN)

(72) Inventor: Xiaoyu Huang, Guangdong (CN)

(73) Assignees: HKC Corporation Limited, Shenzhen (CN); Chongqing HKC Optoelectronics Technology Co., Ltd., Chongqing (CN)

( * ) Notice: Subject to any disclaimer, the term of this patent is extended or adjusted under 35 U.S.C. 154(b) by 152 days.

(21) Appl. No.: 16/317,036

(22) PCT Filed: Dec. 4, 2018

(86) PCT No.: PCT/CN2018/119047
§ 371 (c)(1),
(2) Date: Jan. 11, 2019

(87) PCT Pub. No.: WO2020/062551
PCT Pub. Date: Apr. 2, 2020

(65) Prior Publication Data

US 2020/0251056 A1 Aug. 6, 2020

(30) Foreign Application Priority Data

Sep. 30, 2018 (CN) ..... 201821620918.6

(51) Int. Cl.
*G09G 3/20* (2006.01)
*G09G 3/3258* (2016.01)
*G09G 3/36* (2006.01)

(52) U.S. Cl.
CPC ..... *G09G 3/2096* (2013.01); *G09G 3/3258* (2013.01); *G09G 3/3648* (2013.01); *G09G 2310/08* (2013.01); *G09G 2330/021* (2013.01)

(58) Field of Classification Search
CPC ..... G09G 3/3258; G09G 3/3648; G09G 2310/08; G09G 2330/02; G09G 2330/021;
(Continued)

(56) References Cited

U.S. PATENT DOCUMENTS 10,007,631 B2 * 6/2018 Park ..... G06F 13/4282
2016/0321208 A1 * 11/2016 Park ..... G06F 12/0246
2020/0043439 A1 * 2/2020 Hwang ..... G06T 1/60

FOREIGN PATENT DOCUMENTS

CN 102237037 A 11/2011
CN 202134195 U 2/2012
(Continued)

*Primary Examiner* — Jason M Mandeville

(57) ABSTRACT

The present application discloses a display panel driving circuit, and a display device. The circuit includes: a memory; a communication switching circuit; a timing controller including a data transmission port and a controlling port, the data transmission port connects to a communication signal output port of the communication switching circuit and a data output port of the memory, the controlling port connects to a driving signal input port of the communication switching circuit, a reference voltage input port connects to a driving power supply through a connector; wherein, the timing controller is configured to receive a communication signal accessed from the serial communication bus when the communication switching circuit is turned on, and to read software data of the memory when the communication switching circuit is turned off.

17 Claims, 3 Drawing Sheets

(58) Field of Classification Search
CPC ..... G09G 2330/026; G09G 2330/027; G09G 3/2096
USPC ..... 345/204, 211–213
See application file for complete search history.

(56) References Cited

FOREIGN PATENT DOCUMENTS

| | | | |
|---|---|---|---|
| CN | 102968960 | A | 3/2013 |
| CN | 203466798 | | 3/2014 |
| CN | 105427822 | A | 3/2016 |
| CN | 107144989 | A | 9/2017 |
| CN | 107610664 | A | 1/2018 |
| KR | 20110066735 | A | 6/2011 |

* cited by examiner

DISPLAY PANEL DRIVING CIRCUIT, AND DISPLAY DEVICE

RELEVANT APPLICATION

This application is the national stage of the international application of PCT PCT/CN2018/119047 filed on Dec. 4, 2018, which claims priority to Chinese Patent Application No. 201821620918.6, filed with the Chinese Patent Office on Sep. 30, 2018 and entitled "display panel driving circuit, and display device", which is incorporated herein by reference in its entirety.

FIELD

The present application relates to the field of display driving technology, and in particular, to a display panel driving circuit, and a display device.

BACKGROUND

In a display device, generally data in a static read only memory (SROM) of a timing controller (TCON IC) cannot be saved after power outage, while data stored in an electrically erasable programmable read only memory (EEPROM) or a flash memory (Flash) can still be saved even after power outage. Therefore, control program of the timing controller is stored in an external memory, such as an EEPROM or a Flash. The timing controller initializes and reads timing control data from an internal memory through a bus after power is on, and then connects to an external control chip through the bus.

Since both the memory and the timing controller connect to the timing controller through a communication bus, control signal of the control chip may interfere in data reading between the timing controller and the memory when the timing control data is read from the external memory through the bus, resulting in data reading failure.

SUMMARY

It is one main object of the present application to provide a display panel driving circuit, and a display device, aiming to solve the reading error problem in software of the timing controller, and to improve the reliability of the display device.

In order to realize the above aim, the present application provides a display panel driving circuit including:

a memory;

a connector, configured to connect to a serial communication bus and a driving power supply;

a communication switching circuit, including a reference voltage input port, a driving signal input port, a communication signal input port and a communication signal output port, the communication signal input port communicates with the serial communication bus through the connector;

a timing controller, including a data transmission port and a controlling port, the data transmission port connects to the communication signal output port of the communication switching circuit and a data output port of the memory, the controlling port connects to the driving signal input port of the communication switching circuit, the reference voltage input port connects to the driving power supply through the connector; wherein, the timing controller is configured to output a driving signal to the driving signal input port of the communication switching circuit;

the communication switching circuit is configured to turn on or turn off according to the driving signal and a signal input from the reference voltage input port;

the timing controller is also configured to receive a communication signal accessed from the serial communication bus when the communication switching circuit is turned on, and to read software data of the memory when the communication switching circuit is turned off.

Optionally, the communication switching circuit includes a signal comparing unit, a signal triggering unit, and a communication signal output unit, a first input port of the signal comparing unit is the reference voltage input port, a second input port of the signal comparing unit is the driving signal input port, an output port of the signal comparing unit connects to an input port of the signal triggering unit, an output port of the signal triggering unit connects to a controlled port of the communication signal output unit, an input port of the communication signal output unit connects to the connector, an output port of the communication signal output unit is the communication signal output port of the communication switching circuit.

Optionally, the signal comparing unit includes a first comparator, a normal phase input port of the first comparator is the second input port of the signal comparing unit, a reverse phase input port of the first comparator is the first input port of the signal comparing unit, and an output port of the first comparator is the output port of the signal comparing unit.

Optionally, the display panel driving circuit further includes a first direct current power supply; the signal triggering unit includes a trigger, a clock signal input port of the trigger is the input port of the signal triggering unit, a signal output port of the trigger is the output port of the signal triggering unit, the signal input port of the trigger connects to the first direct current power supply.

Optionally, the signal triggering unit further includes a first resistor, a first port of the first resistor connects to the output port of the signal comparing unit, a second port of the first resistor connects to ground.

Optionally, the communication signal output unit includes a first electronic switch, a second resistor, a controlled port of the first electronic switch is the controlled port of the communication signal output unit, an input port of the first electronic switch is the input port of the communication signal output unit, an output port of the electronic switch is the output port of the communication signal output unit; a first port of the second resistor connects to the controlled port of the first electronic switch, a second port of the second resistor connects to the input port of the first electronic switch.

Optionally, the display panel driving circuit further includes a unilateral member, an input port of the unilateral member connects to the memory, an output port of the unilateral member connects to the timing controller.

Optionally, the display panel driving circuit further includes a gate driving circuit and a source driving circuit, a controlled port of the gate driving circuit and a controlled port of the source driving circuit connect to an output port of the timing controller respectively.

The present application further provides a display device including: a display panel and a display panel driving circuit described as above, the display panel driving circuit includes:

a memory;

a connector, which is configured to connect to a serial communication bus and a driving power supply;

a communication switching circuit, including a reference voltage input port, a driving signal input port, a communication signal input port and a communication signal output port, the communication signal input port communicates with the serial communication bus through the connector;

a timing controller, including a data transmission port and a controlling port, the data transmission port connects to the communication signal output port of the communication switching circuit and a data output port of the memory, the controlling port connects to the driving signal input port of the communication switching circuit, the reference voltage input port connects to the driving power supply through the connector; wherein, the timing controller is configured to output a driving signal to the driving signal input port of the communication switching circuit;

the communication switching circuit is configured to turn on or turn off according to the driving signal and a signal input from the reference voltage input port;

the timing controller is also configured to receive a communication signal accessed from the serial communication bus when the communication switching circuit is turned on, and to read software data of the memory when the communication switching circuit is turned off;

a gate driving circuit and a source driving circuit of the display panel driving circuit electrically connect to the display panel respectively.

Optionally, the display device further includes a power management circuit, an input port of the power management circuit connects to the driving power supply through the connector of the display panel driving circuit, an output port of the power management circuit connects to the gate driving circuit, the source driving circuit and the timing controller of the display panel driving circuit respectively.

Optionally, the communication switching circuit includes a signal comparing unit, a signal triggering unit, and a communication signal output unit, a first input port of the signal comparing unit is the reference voltage input port, a second input port of the signal comparing unit is the driving signal input port, an output port of the signal comparing unit connects to an input port of the signal triggering unit, an output port of the signal triggering unit connects to a controlled port of the communication signal output unit, an input port of the communication signal output unit connects to the connector, an output port of the communication signal output unit is the communication signal output port of the communication switching circuit.

Optionally, the signal comparing unit includes a first comparator, a normal phase input port of the first comparator is the second input port of the signal comparing unit, a reverse phase input port of the first comparator is the first input port of the signal comparing unit, and an output port of the first comparator is the output port of the signal comparing unit.

Optionally, the display device further includes a first direct current power supply; the signal triggering unit includes a trigger, a clock signal input port of the trigger is the input port of the signal triggering unit, a signal output port of the trigger is the output port of the signal triggering unit, the signal input port of the trigger connects to the first direct current power supply.

Optionally, the signal triggering unit further includes a first resistor, a first port of the first resistor connects to the output port of the signal comparing unit, a second port of the first resistor connects to ground.

Optionally, the communication signal output unit includes a first electronic switch, a second resistor, a controlled port of the first electronic switch is the controlled port of the communication signal output unit, an input port of the first electronic switch is the input port of the communication signal output unit, an output port of the electronic switch is the output port of the communication signal output unit; a first port of the second resistor connects to the controlled port of the first electronic switch, a second port of the second resistor connects to the input port of the first electronic switch.

Optionally, the display device further includes a unilateral member, an input port of the unilateral member connects to the memory, an output port of the unilateral member connects to the timing controller.

Optionally, the display panel driving circuit further includes a gate driving circuit and a source driving circuit, a controlled port of the gate driving circuit and a controlled port of the source driving circuit connect to an output port of the timing controller respectively.

Optionally, the display panel is a liquid crystal display or an organic light-emitting diode display.

In the present application, through setting a timing controller and a memory, and communicating by a serial communication bus, and setting a communication switching circuit between a connector used for connecting to an external control chip and the timing controller in series, the communication switching circuit is turned off when the timing controller outputs a driving signal at low level under the control of the driving signal of the timing controller, to implement communication between the timing controller and the memory, and to make the timing controller to read software data in the memory, then to implement the initial setting of the timing controller. When the communication switching circuit is turned on under the control of the driving signal at high level output by the timing controller, the communication between the timing controller and the external control chip is implemented, to receive a control signal output by the external control chip and to convert the control signal to corresponding driving signal and then to output the driving signal, to implement image display of the display panel. The present application solve the problem that data in the memory may rush into the external control chip when the timing controller read the data in the memory, leading to an operation disorder in the external control chip, or a data signal of the external control chip is output to the timing controller or the memory, leading to failure of timing controller reading data in the memory. The present application solves the reading error problem of the timing controller software, and improves reliability of the display device.

BRIEF DESCRIPTION OF THE DRAWINGS

To illustrate the technical solutions according to the embodiments of the present application or the prior art more clearly, the accompanying drawings for describing the embodiments or the prior art are introduced briefly in the following. Apparently, the accompanying drawings in the following description are only about some embodiments of the present application, and persons of ordinary skill in the art can derive other drawings from the accompanying drawings without creative efforts.

Instructions of labels in drawings

TABLE 1

| Label | Designation |
|---|---|
| 10 | memory |
| 20 | connector |
| 30 | communication switching circuit |
| 40 | timing controller |
| 31 | signal comparing unit |
| 32 | signal triggering unit |
| 33 | communication signal output unit |
| U1 | first comparator |
| R1 | first resistor |
| R2 | second resistor |
| Q1 | first electronic switch |
| VDD | first direct current power supply |
| C | clock signal input port |
| D | data input port |
| Q | data output port |
| U2 | D trigger |

The realizing of the aim, functional characteristics, advantages of the present application are further described in detail with reference to the accompanying drawings and the embodiments.

DETAILED DESCRIPTION

The technical solutions of the embodiments of the present application will be clearly and completely described in the following with reference to the accompanying drawings. It is obvious that the embodiments to be described are only a part rather than all of the embodiments of the present application. All other embodiments obtained by persons skilled in the art based on the embodiments of the present application without creative efforts shall fall within the protection scope of the present application.

It is necessary to explain that, if there are directional instructions in the exemplary embodiments of the present application (such as top, down, left, right, front, back), the directional instructions can only be used for explaining relative position relations, moving condition of the members under a special form (referring to figures), and so on, if the special form changes, the directional instructions changes accordingly.

In addition, if there are descriptions such as the "first", the "second" in the present application, the descriptions can only be used for describing the aim of description, and cannot be understood as indicating or suggesting relative importance or impliedly indicating the number of the indicated technical character. Therefore, the character indicated by the "first", the "second" can express or impliedly include at least one character. In addition, the technical proposal of each exemplary embodiment can be combined with each other, however the technical proposal must base on that the ordinary skill in that art can realize the technical proposal, when the combination of the technical proposals occurs contradiction or cannot realize, it should consider that the combination of the technical proposals does not existed, and is not contained in the protection scope required by the present application.

The present application provides a display panel driving circuit.

Figure 1:
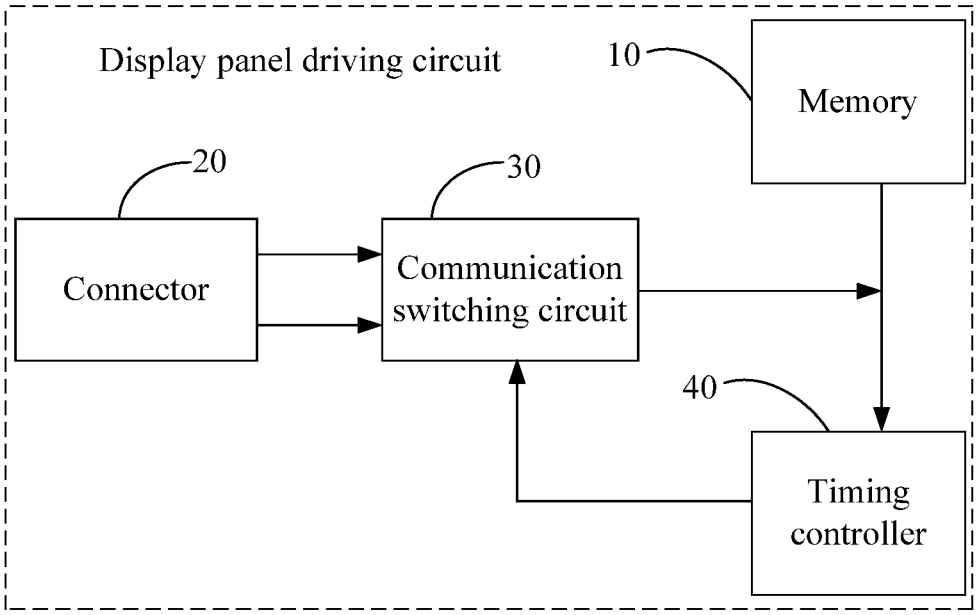
FIG. 1 is a functional module schematic diagram of a display panel driving circuit in an embodiment of the present application.
Figure 2:
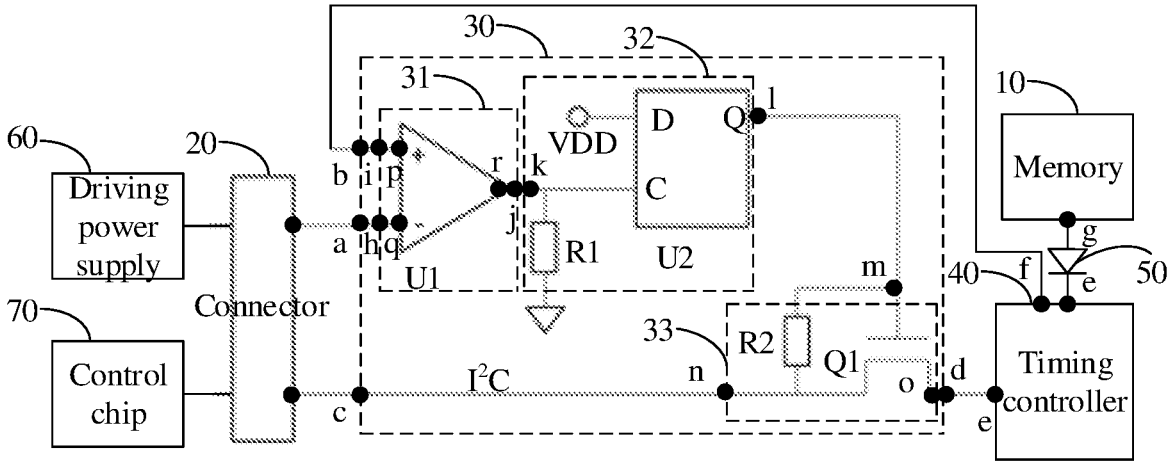
FIG. 2 is a circuit structure schematic diagram of a display panel driving circuit in an embodiment of the present application.
Figure 3:
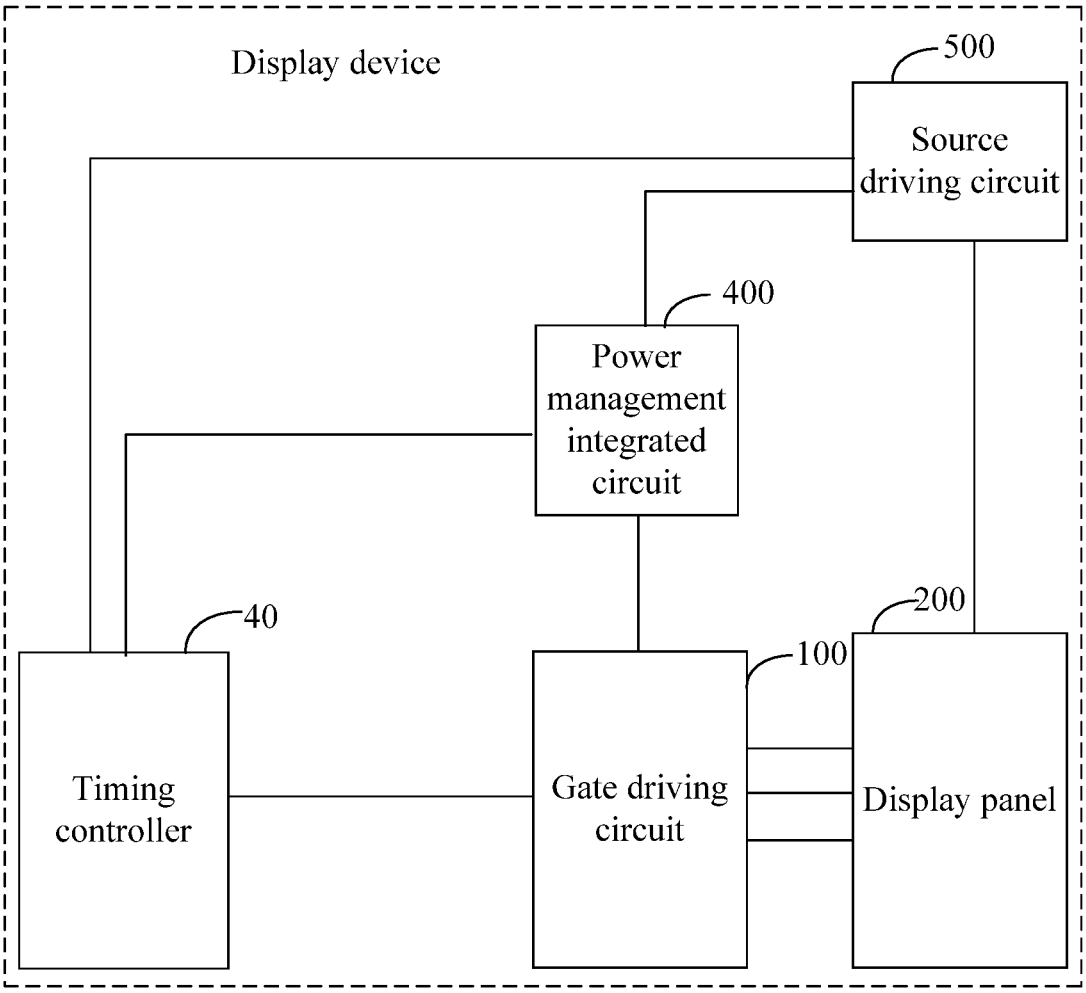
FIG. 3 is a circuit structure schematic diagram of a display device in an embodiment of the present application.

Referring to FIG. 1 to FIG. 3, in an embodiment of the present application, the display panel driving circuit includes:

a memory 10;

a connector 20, which is configured to connect to a serial communication bus and a driving power supply;

a communication switching circuit 30, including a reference voltage input port, a driving signal input port, a communication signal input port and a communication signal output port, the communication signal input port communicates with the serial communication bus through the connector 20;

a timing controller 40, including a data transmission port and a controlling port, the data transmission port connects to the communication signal output port of the communication switching circuit and a data output port of the memory 10, the controlling port connects to the driving signal input port of the communication switching circuit, the reference voltage input port connects to the driving power supply through the connector 20; wherein, the timing controller 40 is configured to output a driving signal to the driving signal input port of the communication switching circuit 30;

the communication switching circuit 30 is configured to turn on or turn off according to the driving signal and a signal input from the reference voltage input port;

the timing controller 40 is also configured to receive a communication signal accessed from the serial communication bus when the communication switching circuit 30 is turned on, and to read software data of the memory 10 when the communication switching circuit is turned off.

In the present application, the display panel driving circuit also includes a gate driving circuit 100, a source driving circuit 500 and a power management integrated circuit 400, a controlled port of the gate driving circuit 100 and a controlled port of the source driving circuit 500 connect to an output port of the timing controller 40 respectively, an input port of the power management integrated circuit connects to the driving power supply through the connector 20, an output port of the power management integrated circuit connects to the timing controller 40, the gate driving circuit 100 and the source driving circuit 500.

The memory 10 and the timing controller 40 can both be configured on the timing controller, TCON PCB. The power management integrated circuit can also be configured on the timing controller, TCON PCB. The power management integrated circuit connects to the driving power supply in the display device through the connector 20, so as to convert the driving power supply, and to provide operation voltage for the timing controller 40, the gate driving circuit 100 and the source driving circuit 500. The memory 10 can store the control signal used for operation of the gate driving circuit 100 and the source driving circuit 500, and communicate with the timing controller 40 through the serial communication bus. When the display device is powered on, the timing controller 40 initializes settings by reading the control signal and other setting data in the memory 10, to generate corresponding timing control signal, and then to drive the source driving circuit 500 and the gate driving circuit 100 in the display device to operate. Data in the memory 10 cannot be modified during the normal operation of the display device. Once the data is modified, the data set will be wrong, which results in abnormal display in the display device. Therefore, the memory 10 is configured with a write protection pin (WP pin) mostly, and the memory 10 is controlled to write data when the high level is input, while the memory cannot write data when the low level is input, and the memory 10 is only available for the timing controller 40 to read data at this time. The timing controller PCB is also configured with the power management integrated circuit, the output port of the power management integrated circuit connects to the memory 10 and the timing controller 40 respectively. In above embodiments, the serial communication bus can adopt an I2Cnter-Integrated Circuit communication bus, or other communication lines to implement of course, and there is no restriction here.

The connector 20 can connect to a control chip of the display device such as a main controller, a video processing chip and so on through a communication bus. Each external control chip connects to the timing controller 40 through the serial communication bus when there are multiple external control chips. The timing controller 40 can receive an R/G/B compression signal and a control signal through the serial communication bus when the display device operates. The driving power supply connects to the power management integrated circuit through a power line. The power management integrated circuit converts power received into corresponding driving power and then outputs it to a circuit module on the timing control PCB. After the display device operates normally, the timing controller 40 converts the R/G/B compression signal and the control signal received into a data signal, a control signal and a clock signal suitable for the source driving circuit 500 and the gate driving circuit 100 in the display device, to realize the image display in the display panel 200.

It is necessary to note that the external control chip, the timing controller 40 and the memory 10 communicate with each other through the serial communication bus, and the timing controller 40 needs to read data in the memory 10 and the external control chip to drive the display panel 200. Therefore, other chips may be affected during data reading process of the timing controller 40. For example, data in the memory 10 may rush into the external control chip through the communication bus when the timing controller 40 reads data in the memory 10, leading to operation disorder of the external control chip, or data signal in the external control chip is output to the timing controller 40 or the memory 10, leading to failure of the timing controller 40 reading data in the memory.

In order to solve the above problems, the display panel driving circuit in the present embodiment can set the communication switching circuit 30 to implement the conversion of communication circuits. Specifically, a reference voltage input port and a driving signal input port of the communication switching circuit 30 connect to the driving power supply and a controlling port of the timing controller 40 respectively, and is turned on/off by receiving a control signal output from the timing controller 40. When the display device is powered on, the timing controller 40 outputs the driving signal at low level to the driving signal input port, the driving signal voltage is less than the driving power supply voltage at this time, and the communication switching circuit 30 is off. The timing controller 40 communicates with the memory 10 through the serial communication bus, to read software data of the memory 10 and to implement initial setting of the timing controller 40. During the process, the communication switching circuit 30 is off, so that no data of the external control chip is output to the memory 10 or the timing controller 40 through the serial communication bus and interferes with the timing controller 40 reading data in the memory 10. At the same time, data in the memory 10 doesn't rush into the external control chip, resulting in dysfunction of the external control chip. At the end of initialization, and the display device operates normally, the timing controller 40 outputs a driving signal at high level to the driving signal input port, and thus drives the communication switching circuit 30 to be turned on, the timing controller 40 communicates with the external control chip through the serial communication bus at this time, and receives the control signal, the data signal and the clock signal output from the external control chip, converts them to corresponding driving signal and then outputs, implements image display in the display panel 200.

In the present application, through setting a timing controller 40 and a memory 10, and communicating by a serial communication bus, and setting a communication switching circuit between a connector 20 used for connecting to an external control chip and the timing controller 40 in series, the communication switching circuit 30 is turned off when the timing controller 40 outputs a driving signal at low level under the control of the driving signal of the timing controller, to implement communication between the timing controller 40 and the memory 10, and to make the timing controller 40 to read software data in the memory 10, then to implement the initial setting of the timing controller 40. When the communication switching circuit 30 is turned on under the control of the driving signal at high level output by the timing controller 40, the communication between the timing controller 40 and the external control chip is implemented, to receive a control signal output by the external control chip and to convert the control signal to corresponding driving signal and then to output the driving signal, to implement image display of the display panel 200. The present application solve the problem that data in the memory 10 may rush into the external control chip when the timing controller 40 read the data in the memory 10, leading to an operation disorder in the external control chip, or a data signal of the external control chip is output to the timing controller 40 or the memory 10, leading to failure of timing controller 40 reading data in the memory 10. The present application solves the reading error problem of the timing controller 40 software, and improves reliability of the display device.

Referring to FIG. 1 to FIG. 3, in an optional embodiment, the communication switching circuit 30 includes a signal comparing unit 31, a signal triggering unit 32, and a communication signal output unit 33, a first input port of the signal comparing unit 31 is the reference voltage input port, a second input port of the signal comparing unit 31 is the driving signal input port, an output port of the signal comparing unit 31 connects to an input port of the signal triggering unit 32, an output port of the signal triggering unit 32 connects to a controlled port of the communication signal output unit 33, an input port of the communication signal output unit 33 connects to the connector 20, an output port of the communication signal output unit 33 is the communication signal output port of the communication switching circuit 30.

In the present embodiment, the first input port and the second input port of the signal second input port and the first input port of the signal comparing unit 31 connect to the controlling port of the timing controller 40 and the driving power supply respectively supply respectively, and are turned on/off by receiving the control signal output from the timing controller 40. A voltage signal value of the second input port is smaller than the power supply voltage value of the first input port when the timing controller 40 outputs the driving signal at low level to the second input port. The voltage signal value of the second input port is larger than the power supply voltage value of the first input port when the timing controller 40 outputs the driving signal at high level to the second input port, to output a trigger signal at high level. The signal triggering unit 32 operates when the signal comparing unit 31 outputs the trigger signal at high level, to turn on the communication signal output unit 33, and to realize the communication between the timing controller 40 and the external control chip through the connector 20 and the communication bus. The signal triggering unit 32 doesn't operate when the signal comparing unit 31 outputs the trigger signal at low level, to turn off the communication signal output unit 33, and to disconnect the communication between the timing controller 40 and the external control chip.

Referring to FIG. 1 to FIG. 3, the signal comparing unit 31 further includes a first comparator U1, a normal phase input port of the first comparator U1 is the second input port of the signal comparing unit 31, a reverse phase input port of the first comparator U1 is the first input port of the signal comparing unit 31, and an output port of the first comparator U1 is the output port of the signal comparing unit 31.

In the present embodiment, the normal phase input port of the first comparator U1 connects to the timing controller 40, the reverse phase input port connects to an external driving power supply through the connector 20. It can be understood that, the voltage value of the driving signal at high level VGH output from the timing controller 40 is larger than the voltage value of the power supply Vin, namely the first comparator U1 outputs the trigger signal at high level to the signal triggering unit 32 when the timing controller 40 outputs the driving signal at high level to the normal phase input port, the first comparator U1 outputs the trigger signal at low level to the signal triggering unit 32 when the timing controller 40 outputs the driving signal at low level to the normal phase input port.

Referring to FIG. 1 to FIG. 3, the display panel 200 driving circuit further includes a first direct current power supply VDD; the signal triggering unit 32 includes a trigger U2, a clock signal input port C of the trigger U2 is the input port of the signal triggering unit 32, a signal output port Q of the trigger U2 is the output port of the signal triggering unit 32, the signal input port D of the trigger U2 connects to the first direct current power supply VDD.

In the present embodiment, the trigger U2 can adopt a D trigger U2, the first direct current power supply VDD can be the power supply of the timing controller 40, namely the power management integrated circuit outputs the first direct current power supply VDD voltage, the first direct current power supply VDD outputs the trigger signal at high level to an N-MOS tube when the D trigger U2 is triggered, to trigger the N-MOS to be turned on. The D trigger U2 operates based on the trigger signal output from the signal comparing unit 31, and outputs the trigger signal at high level to the N-MOS tube when the first comparator U1 outputs the trigger signal at high level to the clock signal input port C and the D trigger U2 is triggered. While the D trigger U2 doesn't operate when the first comparator U1 outputs the trigger signal at low level to the clock signal input port C.

Referring to FIG. 1 to FIG. 3, the signal triggering unit 32 further includes a first resistor R1, a first port of the first resistor R1 connects to the output port of the signal comparing unit 31, a second port of the first resistor R1 connects to ground.

The first resistor R1 is a pull down resistor, configured to output the trigger signal at low level to the clock signal input port of the D trigger U2, to make the D trigger U2 not to operate, and to ensure the N-MOS tube to remain in the cut off state effectively.

Referring to FIG. 1 to FIG. 3, the communication signal output unit 33 further includes a first electronic switch Q1, a second resistor R2, a controlled port of the first electronic switch Q1 is the controlled port of the communication signal output unit 33, an input port of the first electronic switch Q1 is the input port of the communication signal output unit 33, an output port of the electronic switch Q1 is the output port of the communication signal output unit 33; a first port of the second resistor R2 connects to the controlled port of the first electronic switch Q1, a second port of the second resistor R2 connects to the input port of the first electronic switch Q1.

In the present embodiment, the first electronic switch Q1 can be a switching tube such as a triode, a MOS tube and so on, in the present embodiment an N-MOS tube is chosen to implement. The second resistor R2 is a biasing resistor to ensure the N-MOS tube to be turned on reliability. When the display device is powered on, the timing controller 40 outputs the driving signal at low level to the first comparator U1, the first comparator U1 outputs the trigger signal at low level, the clock input port of the D trigger U2 doesn't operate because of the falling edge of the clock, to make the N-MOS tube remain in the cut off state, the timing controller 40 communicates with the memory 10 at this time, to implement the initial setting of the timing controller 40. When the initialization is end and the display device operates normally, the timing controller 40 outputs the driving signal at high level, to trigger the D trigger U2 to output the control signal at high level output from the first direct current power supply VDD to the N-MOS tube, to control the N-MOS tube to be turned on, and to control the timing controller 40 to communicate with the external control chip through the connector 20, to implement the data transmission and image display in the display panel.

Referring to FIG. 1 to FIG. 3, in an optional embodiment, the display panel driving circuit further includes a unilateral member (not shown in the figures), an input port of the unilateral member connects to the memory 10, an output port of the unilateral member connects to the timing controller 40.

It needs to be explained that, data in the memory 10 cannot be modified when the display device operates normally. Once the data is modified, the data set will be wrong, which results in abnormal display in the display device. Therefore, the memory 10 is configured with a write protection pin (WP pin) mostly, and the memory 10 is controlled to write data when the high level is input, while the memory cannot write data at low level to implement the write protection of the memory 10. There is always parasitic capacitance and impedance on the serial communication bus between the timing controller PCB and external, it is prone to cause the generation of clutter on the serial communication bus and the crosstalk rushed into the write protection feet, the high level appears and the memory 10 enters into the write protection state. At this time, if the communication switching circuit 30 is turned on by receiving the control signal output from the timing controller 40, the control signal enters into the memory 10, leading to modification of data in the memory 10.

To solve the above problem, the unilateral member can be an unilateral diode with isolation characteristics such as an optocoupler, a diode and so on. In the present embodiment, the diode can be chosen to implement. The unilateral member is use to prevent data of the external control chip rushing into the memory 10 and data in the memory 10 being modified when the timing controller 40 reads the data of the external control chip.

The present application further provides a display device, including a display panel and a display panel driving circuit described as above, the gate driving circuit 100 and the source driving circuit 500 of the display panel electrically connect to the display panel respectively.

In the present embodiment, a liquid crystal display (LCD), an organic light-emitting diode (OLED) display and other format display can be adopted as the display panel in the display device.

The present application further provides a display device, including a display panel and a display panel driving circuit described as above, the gate driving circuit 100 and the source driving circuit 500 of the display panel electrically connect to the display panel respectively. The detailed structure of the display panel driving circuit may refer to the above embodiments, no need to repeat again here. It can be understood that as the display device adopts all the technical proposals of the above exemplary embodiments of display panel driving circuits, the display device at least has all of the beneficial effects of the technical proposals of the above exemplary embodiments, no need to repeat again.

In the present embodiment, the display device may be a display device with the display panel such as a television, a panel computer, a mobile phone and so on.

The above is only a preferred embodiment of the present application, and thus does not limit the scope of the patent application, and the equivalent structure or equivalent process transformation of the specification and the drawings of the present application, or directly or indirectly applied to other related technical fields. The same is included in the scope of patent protection of this application.

What is claimed is:

1. A display panel driving circuit, wherein the display panel driving circuit comprises:

a memory;

a connector, configured to connect to a serial communication bus and a driving power supply;

a communication switching circuit, comprising a reference voltage input port, a driving signal input port, a communication signal input port, and a communication signal output port, the communication signal input port communicates with the serial communication bus through the connector;

a timing controller, comprising a data transmission port and a controlling port, the data transmission port connects to the communication signal output port of the communication switching circuit and a data output port of the memory, the controlling port connects to the driving signal input port of the communication switching circuit, the reference voltage input port connects to the driving power supply through the connector; wherein, the timing controller is configured to output a driving signal to the driving signal input port of the communication switching circuit;

the communication switching circuit is configured to turn on or turn off according to the driving signal and a signal input from the reference voltage input port;

the timing controller is also configured to receive a communication signal accessed from the serial communication bus when the communication switching circuit is turned on, and to read software data of the memory when the communication switching circuit is turned off;

wherein the communication switching circuit comprises a signal comparing unit, a signal triggering unit, and a communication signal output unit, a first input port of the signal comparing unit is the reference voltage input port, a second input port of the signal comparing unit is the driving signal input port, an output port of the signal comparing unit connects to an input port of the signal triggering unit, an output port of the signal triggering unit connects to a controlled port of the communication signal output unit, an input port of the communication signal output unit connects to the connector, an output port of the communication signal output unit is the communication signal output port of the communication switching circuit.

2. The display panel driving circuit according to claim 1, wherein the signal comparing unit comprises a first comparator, a normal phase input port of the first comparator is the second input port of the signal comparing unit, a reverse phase input port of the first comparator is the first input port of the signal comparing unit, and an output port of the first comparator is the output port of the signal comparing unit.

3. The display panel driving circuit according to claim 1, wherein the display panel driving circuit further comprises a first direct current power supply; the signal triggering unit comprises a trigger, a clock signal input port of the trigger is the input port of the signal triggering unit, a signal output port of the trigger is the output port of the signal triggering unit, the signal input port of the trigger connects to the first direct current power supply.

4. The display panel driving circuit according to claim 1, wherein the signal triggering unit further comprises a first resistor, a first port of the first resistor connects to the output port of the signal comparing unit, a second port of the first resistor connects to ground.

5. The display panel driving circuit according to claim 1, wherein the communication signal output unit comprises a first electronic switch, a second resistor, a controlled port of the first electronic switch is the controlled port of the communication signal output unit, an input port of the first electronic switch is the input port of the communication signal output unit, an output port of the electronic switch is the output port of the communication signal output unit; a first port of the second resistor connects to the controlled port of the first electronic switch, a second port of the second resistor connects to the input port of the first electronic switch.

6. The display panel driving circuit according to claim 1, wherein the display panel driving circuit further comprises a unilateral member, an input port of the unilateral member connects to the memory, an output port of the unilateral member connects to the timing controller.

7. The display panel driving circuit according to claim 6, wherein the unilateral member is an optocoupler or a diode.

8. The display panel driving circuit according to claim 1, wherein the display panel driving circuit further comprises a gate driving circuit and a source driving circuit, a controlled port of the gate driving circuit and a controlled port of the source driving circuit connect to an output port of the timing controller respectively.

9. A display device, wherein the display device comprises a display panel and a display panel driving circuit, the display panel driving circuit comprises:

a memory, the memory is configured with a write protection pin, the memory write data when the write protection pin is at high level, the memory is available for the timing controller to read data when the write protection pin is at low level;

a connector, which is configured to connect to a serial communication bus and a driving power supply;

a communication switching circuit, comprising a reference voltage input port, a driving signal input port, a communication signal input port and a communication signal output port, the communication signal input port communicates with the serial communication bus through the connector;

the timing controller, comprising a data transmission port and a controlling port, the data transmission port connects to the communication signal output port of the communication switching circuit and a data output port of the memory, the controlling port connects to the driving signal input port of the communication switching circuit, the reference voltage input port connects to the driving power supply through the connector; wherein, the timing controller is configured to output a driving signal to the driving signal input port of the communication switching circuit;

the communication switching circuit is configured to turn on or turn off according to the driving signal and a signal input from the reference voltage input port;

the timing controller is also configured to receive a communication signal accessed from the serial communication bus when the communication switching circuit is turned on, and to read software data of the memory when the communication switching circuit is turned off;

a gate driving circuit and a source driving circuit of the display panel driving circuit electrically connect to the display panel respectively;

wherein the communication switching circuit comprises a signal comparing unit, a signal triggering unit, and a communication signal output unit, a first input port of the signal comparing unit is the reference voltage input port, a second input port of the signal comparing unit is the driving signal input port, an output port of the signal comparing unit connects to an input port of the signal triggering unit, an output port of the signal triggering unit connects to a controlled port of the communication signal output unit, an input port of the communication signal output unit connects to the connector, an output port of the communication signal output unit is the communication signal output port of the communication switching circuit.

10. The display device according to claim 9, wherein the display device further comprises a power management circuit, an input port of the power management circuit connects to the driving power supply through the connector of the display panel driving circuit, an output port of the power management circuit connects to the gate driving circuit, the source driving circuit and the timing controller of the display panel driving circuit respectively.

11. The display device according to claim 9, wherein the signal comparing unit comprises a first comparator, a normal phase input port of the first comparator is the second input port of the signal comparing unit, a reverse phase input port of the first comparator is the first input port of the signal comparing unit, and an output port of the first comparator is the output port of the signal comparing unit.

12. The display device according to claim 9, wherein the display device further comprises a first direct current power supply; the signal triggering unit comprises a trigger, a clock signal input port of the trigger is the input port of the signal triggering unit, a signal output port of the trigger is the output port of the signal triggering unit, the signal input port of the trigger connects to the first direct current power supply.

13. The display device according to claim 9, wherein the signal triggering unit further comprises a first resistor, a first port of the first resistor connects to the output port of the signal comparing unit, a second port of the first resistor connects to ground.

14. The display device according to claim 9, wherein the communication signal output unit comprises a first electronic switch, a second resistor, a controlled port of the first electronic switch is the controlled port of the communication signal output unit, an input port of the first electronic switch is the input port of the communication signal output unit, an output port of the electronic switch is the output port of the communication signal output unit; a first port of the second resistor connects to the controlled port of the first electronic switch, a second port of the second resistor connects to the input port of the first electronic switch.

15. The display device according to claim 9, wherein the display device further comprises a unilateral member, an input port of the unilateral member connects to the memory, an output port of the unilateral member connects to the timing controller.

16. The display device according to claim 9, wherein the display panel driving circuit further comprises a gate driving circuit and a source driving circuit, a controlled port of the gate driving circuit and a controlled port of the source driving circuit connect to an output port of the timing controller respectively.

17. The display device according to claim 9, wherein the display panel is a liquid crystal display or an organic light-emitting diode display.

* * * * *